US005871368A

United States Patent [19]

Erdner et al.

[11] Patent Number: 5,871,368

[45] Date of Patent: Feb. 16, 1999

[54] BUS CONNECTOR

[75] Inventors: Todd D. Erdner, Stanford, Calif.; Frank Hart, Beaverton, Oreg.

[73] Assignee: Intel Corporation, Santa Clara, Calif.

[21] Appl. No.: 751,805

[22] Filed: Nov. 19, 1996

[51] Int. Cl.[6] ..... H01R 29/00

[52] U.S. Cl. ..... 439/188

[58] Field of Search ..... 439/188, 489, 439/490; 361/686

[56] References Cited

U.S. PATENT DOCUMENTS

| | | | |
|---|---|---|---|
| 5,131,865 | 7/1992 | Taguchi et al. | 439/489 |
| 5,417,586 | 5/1995 | Endo et al. | 439/489 |
| 5,463,742 | 10/1995 | Kobayashi | 361/686 |
| 5,593,311 | 1/1997 | Lybrand | 439/188 |
| 5,668,419 | 9/1997 | Oktay | 439/188 |

OTHER PUBLICATIONS

Maxim Integrated Products, No. 19–0380, Mar. 1996: *1μA Supply Current, 1.8V to 4.25V–Powered RS–232 Transceiver with AutoShutdown™*, 12 pages.

*Primary Examiner*—Steven L. Stephan
*Assistant Examiner*—T C Patel
*Attorney, Agent, or Firm*—Kenyon & Kenyon

[57] ABSTRACT

A power supply supplies power from a bus at a hub to a peripheral over a bus which plugs into a connector at the hub, the connector having a plurality of contacts, including at least two power contacts the power supply. When the bus is plugged into the connector, a mated contact is provided in the connector at the hub. When a mating connector on the bus is plugged in, one of the plurality of contacts is shorted to the mated contact. The sensed shorting at the mated contact is used to control the ramping of current on the power lines of connector.

19 Claims, 4 Drawing Sheets

58

44
41

17
43
101
58
$V_{BUS}$
13
107
CONTROLLER
D+
D-
109
CURRENT CONTROL
108
105
MICROPROCESSOR
111
POWER SUPPLY
103

BUS CONNECTOR

BACKGROUND OF THE INVENTION

The present invention relates to the supply of power to peripherals in general and more particularly, to a method and apparatus which enables the control of current ramp-up when a peripheral is coupled to a bus.

Computer users have found a need to couple an increasing number of peripherals to their computers. In order to accommodate this, a number of buses have been developed. One such bus is known as the Universal Serial Bus (USB). The USB is a low-to-medium speed serial bus developed by the Intel Corporation to address peripheral expansion outside the PC system box. The USB is a peripheral bus standard that permits the use of plug and play computer peripherals outside the box, reducing the need to install cards into dedicated computer slots and reconfigure the system. In personal computers equipped with USB, computer peripherals can be automatically configured as soon as they are physically attached without the need to reboot or run setup. USB also allows up to 127 devices to run simultaneously on a computer, with peripherals such as monitors and keyboards operating as additional plug-in sites, or hubs.

USB will accommodate telephones, modems, keyboards, mice, 4× and 6× CD ROM drives, joysticks, tape and floppy drives, scanners and printers. USB's 12 megabit data rate will also accommodate a whole new generation of peripherals, including MPEG-2 video-based products, data gloves and digitizers. Also, since computer-telephony integration is expected to be a big growth area for PCs, USB will provide a low-cost interface for Integrated Services Digital Network (ISDN) and digital PBXs.

Drawing its intelligence from the host PC, USB detects when devices are added and removed. The bus automatically determines the host resource, including driver software and bus bandwidth, each peripheral needs and makes those resources available without user intervention. Users with a USB-equipped PC will be able to switch out compatible peripherals as needed as easily as they would plug in a lamp.

USB transfers signals and power over a four wire cable. The signaling occurs over two wires in point-to-point segments. The cable also carries Vbus (VCC) and GND wires on each segment to deliver power to peripheral devices. Vbus is nominally +5 V at the source. Each USB segment provides a limited amount of power over the cable. The host supplies power for use by USB devices that are directly coupled to it. In addition, any USB device may have its own power supply. USB devices that rely totally on power from the cable are called bus-powered devices. In contrast, those that have an alternate source of power are called self-powered devices. A hub also supplies power for its coupled USB devices.

The connectors used with the bus are four pin connectors in which the pin assignments are as follows:

pin 1 VCC (Cable power or Vbus)

pin 2−Data pin 3+Data pin 4 Ground (Cable ground)

Detailed specifications for the USB including the power supply and the connectors may be found in *Universal Serial Bus Specification*, Revision 1.0, Jan. 15, 1996, Copyright© 1996, Compaq Computer Corporation, Digital Equipment Corporation, IBM PC Company, Intel Corporation, Microsoft Corporation, NEC, Northern Telecom.

SUMMARY OF THE INVENTION

The present invention provides a connector adapted to accept a mating connector on the end of a bus. The connector includes at least a pair of power contacts or pins and an additional contact or pin, mated to one of the contacts, such that, when a mating connector is plugged into the connector, the additional mated contact is brought into contact with the contact to which it is mated. In an illustrated embodiment the mated contact is then used to control the ramp-up of current to a peripheral on the other end of the bus through a conventional software or hardware arrangement.

DETAILED DESCRIPTION

The Universal Serial Bus specification although describing power requirements in detail, fails to address mobile and low power issues. Specifically, the Universal Serial Bus specification does not provide a mechanism for controlling the ramp rate of the Vbus current. On low power devices, such as notebook systems, some power supplies may not be able to handle the large step load which occurs when a peripheral which is a bus powered device is plugged into the bus. At the very least, these loads can lead to low battery life. In order to make the power supply handle the large step load, a designer would need to implement a higher frequency design or use more expensive components. This may cause either an efficiency loss or cost increase.

Thus, there is a need in a bus, such as the USB, in which power is supplied over the bus to peripherals outside PC system box, for a way to control the ramp rate of the Vbus current. Embodiments of the present invention which solve this problem will be discussed using the Universal Serial Bus (USB) as an example. As will become apparent below, however, the method and apparatus used in these embodiments is more generally applicable in any situation where making a connection to a cable, such as a bus cable, results in a step increase in current beyond the capability of the power supply, or which in some other way could be detrimental to the system.

Figure 1:
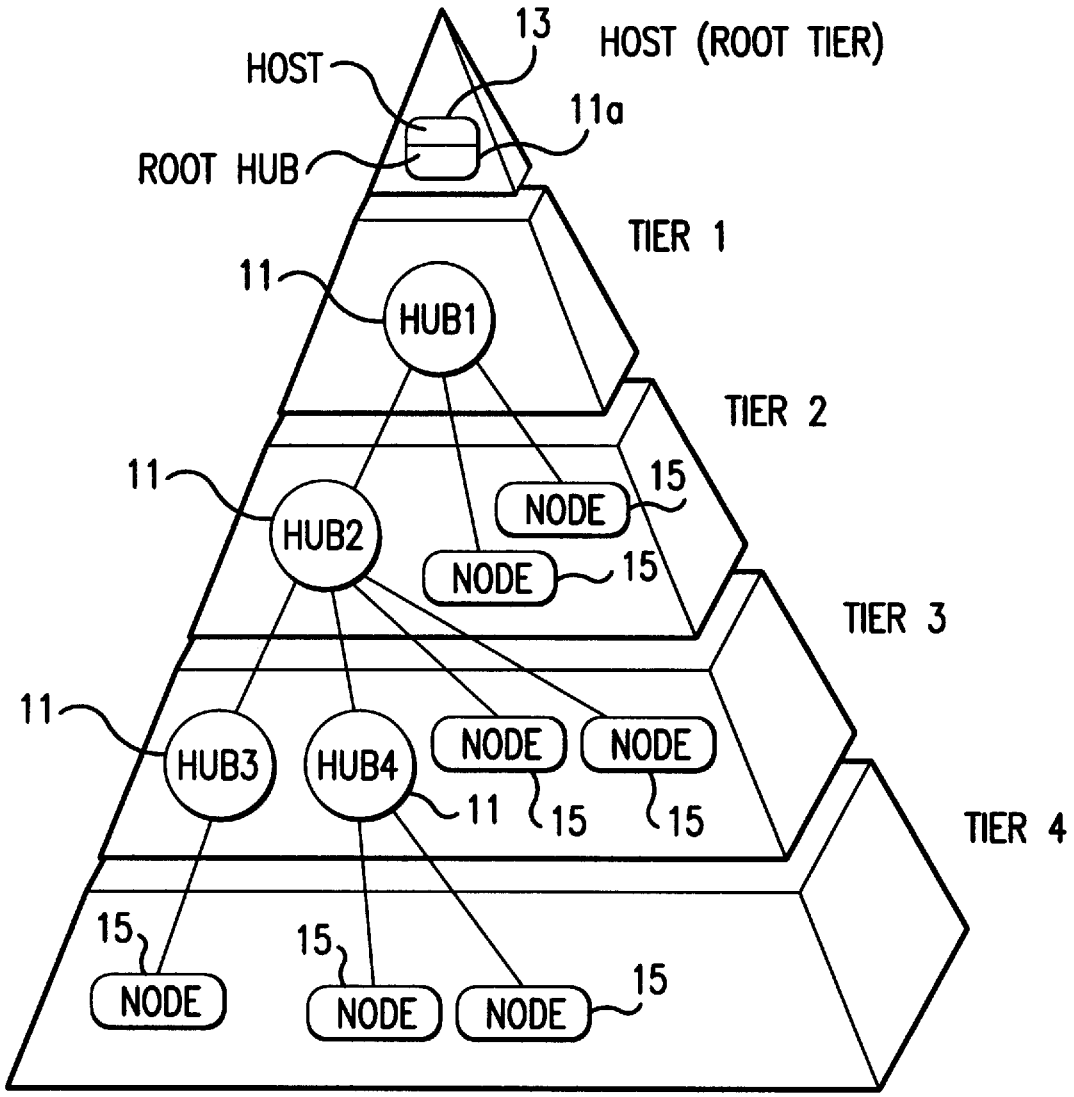
FIG. 1 illustrates the general architecture of the USB physical interconnect in a tiered star topology

The USB bus couples USB devices with a USB host. As illustrated in FIG. 1, the general architecture of the USB physical intercoupling is a tiered star topology. A hub 11 is at the center of each star. Each wire segment is a point-to-point connection between the root hub 11*a* of a host 13 and a hub 11 or function node 15, or between a hub 11 coupled to another hub 11 or function node 15. There is only one host 13 on any USB system. The USB interface to the host computer system is referred to as the host controller. The host controller may be implemented in a combination of hardware, firmware, or software. The root hub 11*a* is integrated within the host system to provide one or more attachment points. Details of the USB system are found in the previously mentioned *Universal Serial Bus Specification.*

Figure 2:
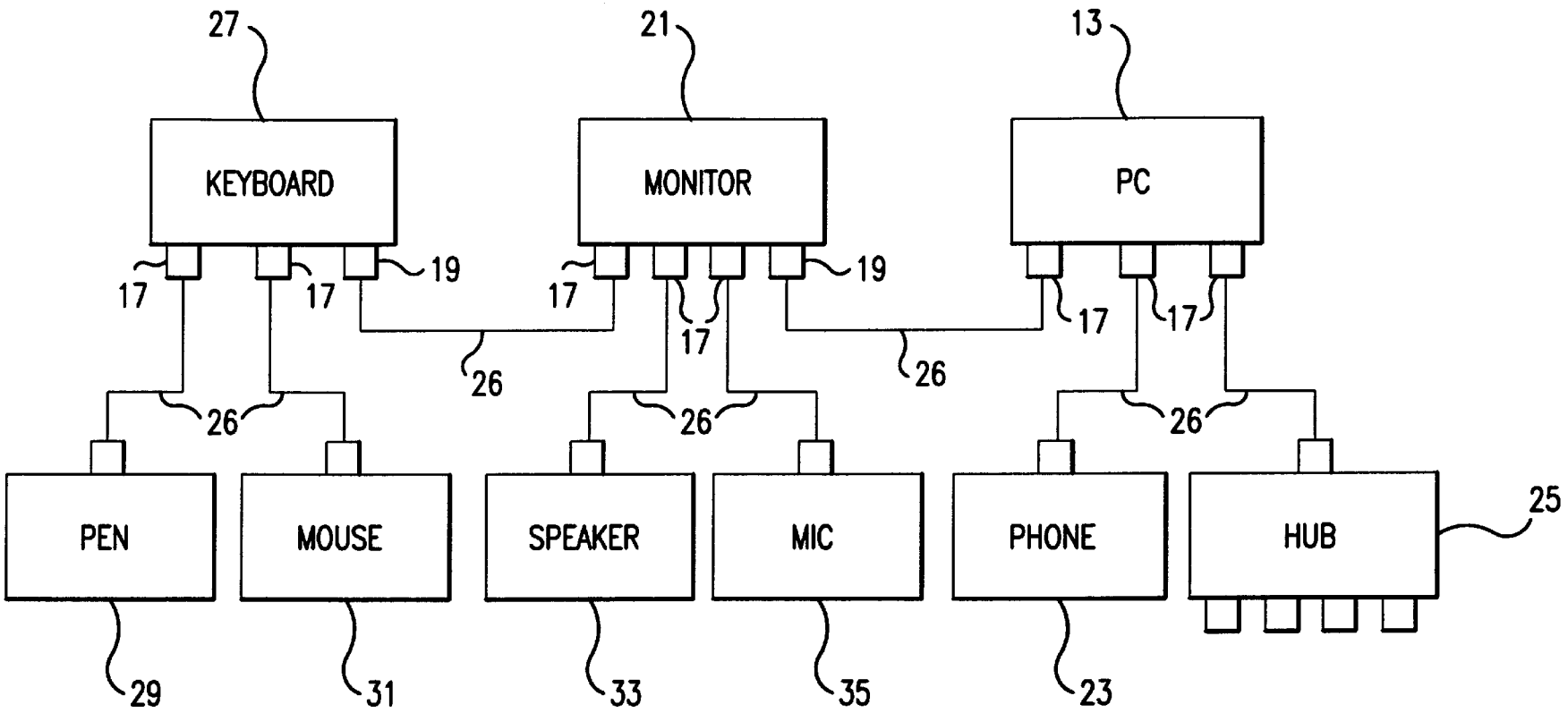
FIG. 2 is a block diagram illustrating an embodiment of a typical USB application.

FIG. 2 illustrates a typical application. Shown is a host PC 13 with three connectors 17, coupling respectively to a monitor 21 which has the dual purpose of being a function node and a hub; a phone 23 and a hub 25. The PC 13 could be a laptop PC to which the monitor 21, phone 23 and hub 25 are coupled when the computer is being used in the office. The monitor 21 has one input connector 19 and three output connectors 17. A keyboard 27, which also is a function node and a hub, has three connectors: two output connectors 17 and an input connector 19. Output connectors 17 couple to additional functions, pen 29 and mouse 31. The monitor 21 is the hub for the keyboard 27 and also acts as a hub for a speaker 33 and a microphone 35. Each hub to hub or hub to function node connection is via a serial bus cable 26. Although some of the hubs or function nodes coupled to the PC 13 may have their own power, others such as, for example, the hub 25 to which additional peripherals maybe coupled, and the phone 23 will need to be powered from the PC 13.

Each of the serial bus cables is a four-wire cable, which terminates, at least at the end which couples with an output connector 17, in a connector with four contacts or contacts. In the illustrated embodiment, output connectors 17 are receptacles for receiving a plug on the end of a bus cable. As noted above, the contacts of connectors 17 are defined as Vbus D+, D−, and GND. Thus, connectors may be installed at a host or at a hub at which a bus having lines for power and data is present. The hub typically will include a power supply coupled to the power lines of the bus.

Figure 3:
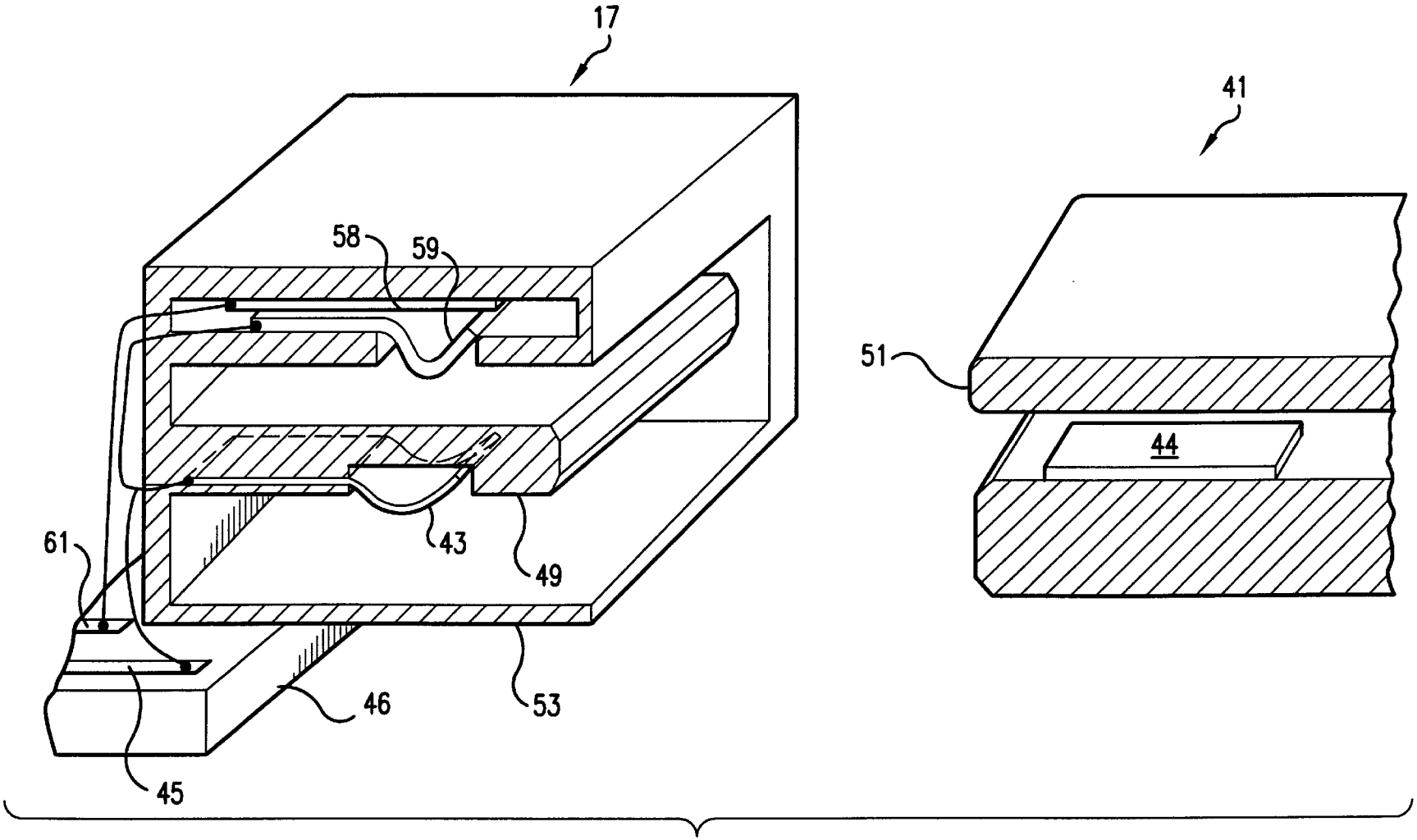
FIG. 3 is a cross sectional perspective view illustrating an embodiment of a connector and mating connector according to the present invention.
Figures 4, 5:
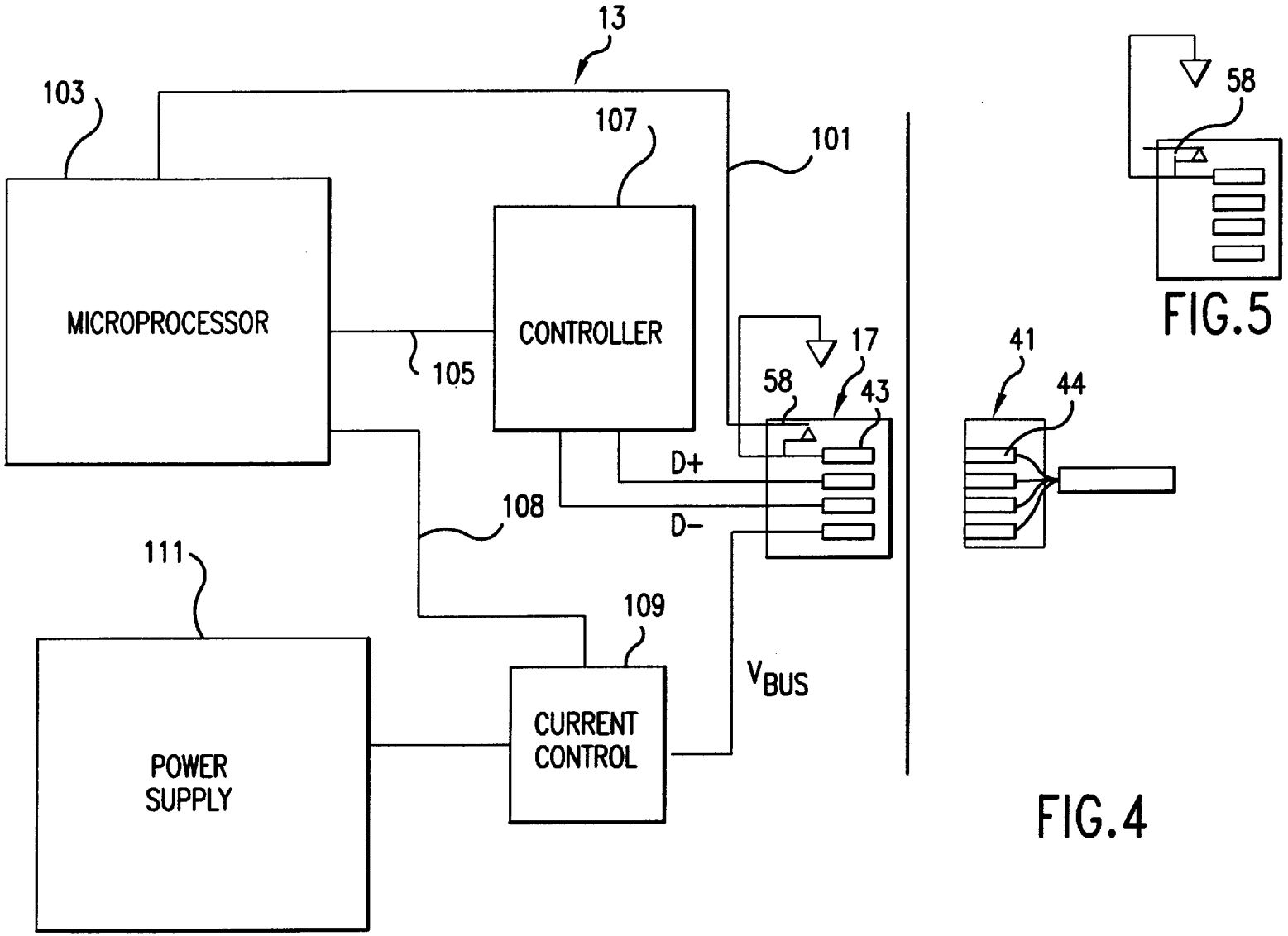
FIG. 4 is a block diagram of a host having the embodiment of FIG. 3.
FIG. 5 shows a portion of the block diagram of FIG. 4, illustrating the mating contact shorted to ground, for the embodiment of FIG. 3.

The data and power lines of the bus, which may be present on traces of a printed circuit board, are coupled to the contacts of the connector with an additional trace on the board coupled to a mated contact. In the embodiment illustrated in FIG. 3, the plurality of signal and power contacts include a pair of data contacts and a pair of power contacts. The power contacts include a voltage contact and a ground contact and the mated contact is mated to the ground contact. It would be equally possible to mate it to any of the other contacts. Thus, in this particular embodiment, the connector 17 and its mating connector 41 are illustrated in the cross sectional perspective view of FIG. 3. The connector 17 illustrated in FIG. 3 includes the four contacts, Vbus, D+, D− and GND each coupled to a trace on a printed circuit board 46 within the PC 13, for example. In FIG. 3 only the GND contact 43 is shown; all four contacts are shown in FIG. 4 below. As noted above, a problem occurs when a peripheral, such as the phone 23 or hub 25 of FIG. 2 is plugged into the connector 17 at host 13, particularly where the host is, for example, a notebook PC. The host is required to supply a certain amount of power to the hub peripherals. This may result in a large step current load which is difficult for the power supply of a notebook PC 13 to supply.

To address this issue, which is not dealt with in the USB specification, the illustrated embodiment, in accordance with the present invention, provides a connector, e.g., a receptacle 17, that is, for this particular embodiment, substantially the same as a conventional connector on the outside, but contains an additional contact 58 going to the printed circuit board 46. Of course such substantial similarity is not a requirement; other embodiments are possible, within the scope of the present invention. The cross sectional perspective view of FIG. 3 shows the receptacle 17 and a mating plug 41. As noted above, just one set of contacts 43 and 44 are shown. Contact 43 in the receptacle 17 is the GND contact mating with GND contact 44 in the plug. Contact 43 is coupled to a trace 45 on the printed circuit board 46 in the host. Contact 43 is resiliently supported on a projection 49 in the receptacle 17. The housing 51 of the plug fits between this projection and the housing 53 of the receptacle. When the plug 41 is inserted into the receptacle 17, contact 43 mates with contact 44. The other three contacts (not shown) mate in similar fashion. A retaining spring 59 holds the housing 51 in place. A similar spring can be provided on the bottom of the housing 53. In accordance with the present invention, a further, e.g., a fifth contact 58, in this case, is provided and coupled to a trace 61 on the printed circuit board 46. In the illustrated embodiment, it cooperates with the spring 59, which is coupled to the GND contact 43. When the cable connector 41 is plugged into the receptacle 17, spring 59 is brought into contact with contact 58 is, thus, shorted to ground. The plug 41 that plugs into connector 17, located, for example, at the host computer 13, can be the same as the cable plug that is defined by the USB specification, in an embodiment where the receptacle is substantially the same as the conventional receptacle. Of course, as noted above, implementation of the present invention does not require the use of existing USB standards. The fifth contact 58 only interfaces with the printed circuit board and is internally shorted to the ground.

Thus, when used in a computer system, a bus cable having the mating connector 41 on one end thereof is coupled to the hub connector 17 and when plugged in causes the additional mated contact to be brought into contact with the contact to which it is mated. The mating connector can, but need not, be the same connector usable with a bus connector without the mated contact. A peripheral to which signals and power are supplied via the bus cable is coupled at the other end of the cable.

Embodiments of the present invention are particularly useful in a computer system having a computer with a processor and a power supply, to which the hub is coupled, the hub power supply being the computer power supply and the computer being a host for the peripheral. There is a particular advantage when the computer is a portable notebook or laptop personal computer with a housing, e.g., a box, having a small form factor. The hub is installed within the housing of the computer and the peripheral is external to the housing. As noted above, the power supplies in such computers may have difficulty in dealing with the step increase in current which will take place if the serial bus cable is immediately couples to the power line or rails of the bus. However, use of the embodiments of the present invention in other applications such as desktop computers, and hubs in a tiered system where the hubs supply power to peripherals is also possible.

The configuration of the new connector 17 is illustrated schematically in the block diagram of FIG. 4, which is a block diagram of a computer such as a laptop computer 13, including an embodiment of the present invention. When no cable is plugged into the connector, the mated contact 58 is not coupled to anything as illustrated in FIG. 4. When the cable connector is plugged in, the contact is shorted to ground as illustrated in FIG. 5.

Although in the illustrated embodiment, the mated contact 58 is shorted to the GND contact, as noted above, it would be equally well be possible to short it to the Vbus, D+or D− or to the shell ground of the connector. By means of an embodiment of the connector of the present invention the use of USB in a mobile environment becomes more practical. This embodiment of the present invention presents a feasible solution to a problem that could limit the use of USB and similar buses in the notebook environment.

The mated contact 58 provides an input signal to circuits in the PC 13 that can be utilized in known fashion to control the ramp-up of current on the Vbus rail. Using conventional techniques, the ground on contact 58 may be sensed by hardware or software adapted to control the power supply hardware to ramp up the current output signal in a controlled fashion. As illustrated in FIG. 4, mated contact 58 may be coupled to a line 101 which is a GP (general purpose) input to a microprocessor 103. The microprocessor is also coupled over a line 105 to the host hub controller 107 which couples to the data lines D+ and D− at the receptacle 17. The Vbus line is coupled to the output terminal of a current control 109 which is interposed between the power supply 111 for the computer and the Vbus line of the connector. When the plug 41 is plugged into the receptacle 17, the mated contact 58 is shorted to ground as shown in FIG. 5 and ground appears on line 101. This is sensed by the microprocessor which then provides an output signal online 108 to the current control 109 to initiate, for example, a hardware sequence which will ramp up the current on the Vbus line at the connector 17 to reduce overloading the power supply 111 with a large step increase in power. Alternatively, in well known fashion, the mated contact 58 input terminal on line 101 may be used to directly control a hardware sequence. Further, although coupling directly to a microprocessor is shown here, it would be equally possible to use controlled hardware in implementing an embodiment of the present invention.

Thus, embodiments of the present invention provide a method of reducing the overloading of a power supply which supplies power from a bus, such as the Universal Serial Bus at a hub or a host computer, to a peripheral, over a bus cable which plugs into a connector at the hub or host, through the use of a connector at the hub or host having a plurality of contacts, one for each signal line and each power line of the bus, along with a contact mated to one of the bus contacts. When the cable connector is plugged into the connector at the hub or host, one of the plurality of contacts is shorted to the mated contact. The shorting at the mated contact is sensed and the ramping of current on the power lines is controlled in response to the sensing.

The present invention may be used with the Universal Serial Bus. However, it application is not so limited; it is useful in any situation where plugging a serial or parallel bus cable, which includes at least a pair of power conductors, for a peripheral into a hub or host would result in a step increase in power. It will be recognized that various modifications beyond those disclosed may be made without departing from the spirit of the invention which is intended to be limited solely by the appended claims.

What is claimed is:

1. A connector adapted to accept a mating connector on the end of a bus comprising:

a. a plurality of contacts including at least two power contacts, each adapted to make contact with a corresponding contact in the mating connector; and b. an additional contact mated to one of said plurality of contacts, such that, when no mating connector is plugged into said connector, said mated contact is not shorted to said one of said plurality of contacts and when a mating connector is plugged into said connector, said additional mated contact is shorted to the one of said plurality of contacts to which it is mated.

2. A connector according to claim 1 wherein said plurality of contacts include a pair of data contacts and a pair of power contacts.

3. A connector according to claim 2 where said bus is a Universal Serial Bus.

4. A connector according to claim 3 wherein said power contacts include a voltage contact and a ground contact and said mated contact is adapted to be mated to said ground contact.

5. A bus hub comprising:

a. a bus which has lines for power and data; and b. a connector adapted to accept a mating connector, said connector including a plurality of contacts, one coupled to each line of said bus and each adapted to make contact with a corresponding contact in the mating connector, and an additional contact mated to one of said plurality of contacts, such that, when no mating connector is plugged into said connector, said additional contact is not shorted to said one of said plurality of contacts and, when a mating connector is plugged into said connector, said additional mated contact is shorted to the one of said plurality of contacts to which is mated.

6. A bus hub according to claim 5 wherein said plurality of contacts include a pair of data contacts and a pair of power contacts.

7. A bus hub according to claim 6 wherein said bus is a Universal Serial Bus.

8. A bus hub according to claim 6 wherein said power contacts include a voltage contact and a ground contact and said mated contact is mated to said ground contact.

9. A bus hub according to claim 5 and further including a printed circuit board on which traces for said bus lines are formed, said plurality of contacts coupled to said traces and further including an additional trace to which said mated contact is coupled.

10. A computer system comprising:

a. a hub including:

i. a bus which has lines for power; and ii. a hub connector including a plurality of contacts, each coupled to a respective line of said bus and each adapted to make contact with a corresponding contact in the mating connector, and an additional contact mated to one of said plurality of contacts such that, when no mating connector is plugged into said connector, said additional contact is not shorted to said one of said plurality of contacts and, when a mating connector is plugged into said connector, said additional mated contact is shorted to the one of said plurality of contacts to which is mated, b. a bus having a mating connector on one end thereof coupled to said hub connector said mating connector causing said additional mated contact to be shorted to the one of said plurality of contacts to which it is mated; and c. a peripheral at the other end of said bus to which power is supplied via said bus.

11. A computer system according to claim 10 wherein said plurality of contacts include a pair of data contacts and a pair of power contacts.

12. A computer system according to claim 11 wherein said power contacts include a voltage contact and a ground contact and said mated contact is mated to said ground contact.

13. A computer system according to claim 10 and further including a computer with a processor and a power supply, said computer being a host for said peripheral and said power lines of said bus coupled to said power supply.

14. A computer system according to claim 13 wherein said computer is a personal computer with a housing, said hub installed within the housing of said computer and said peripheral being external to said housing.

15. A computer system according to claim 14 wherein said personal computer is a laptop computer.

16. A computer system according to claim 14 wherein said bus is a Universal Serial Bus.

17. A computer system according to claim 14 and further including a printed circuit board on which traces for said bus lines are formed, said plurality of contacts coupled to said traces and further including an additional trace to which said mated contact is coupled.

18. A method of reducing the overloading of a power supply which supplies power from a bus at a hub to a peripheral over a bus which plugs into a connector at the hub, said connector having a plurality of contacts, including at least two power contacts, when a mating connector on the bus is plugged into said connector, comprising:

a. shorting one of said plurality of contacts to a mated contact;

b. sensing the shorting at said mated contact; and c. controlling the ramping of current on the power contacts of said connector in response to said sensing.

19. A method according to claim 18 where in one of said power contacts is a ground contact and said mated contact is shorted to said ground contact.

* * * * *